United States Patent [19]

Fröhlich

[11] 4,398,571

[45] Aug. 16, 1983

[54] SLIDE FASTENER STRINGER AND METHOD OF MAKING SAME

[75] Inventor: Alfons Fröhlich, Essen, Fed. Rep. of Germany

[73] Assignee: Opti Patent-, Forschungs- und Fabrikations-AG, Riedern-Allmeind, Switzerland

[21] Appl. No.: 272,471

[22] Filed: Jun. 11, 1981

[30] Foreign Application Priority Data

Jun. 12, 1980 [DE] Fed. Rep. of Germany ..... 3022032

[51] Int. Cl.[3] ..... D03D 1/00; A44B 19/34

[52] U.S. Cl. ..... 139/384 B; 24/205.16 C

[58] Field of Search ..... 139/384 B, 384 R, 116; 24/205.1 C, 205.13 C, 205.16 C

[56] References Cited

U.S. PATENT DOCUMENTS

| | | | |
|---|---|---|---|
| 3,847,188 | 11/1974 | Auer et al. | 139/384 B |
| 3,961,652 | 6/1976 | Hasuda et al. | 139/384 B |
| 4,344,556 | 6/1982 | Fröhlich et al. | 139/384 B |

FOREIGN PATENT DOCUMENTS

| | | | |
|---|---|---|---|
| 2707357 | 8/1978 | Fed. Rep. of Germany | 24/205.16 C |

*Primary Examiner*—James Kee Chi

*Attorney, Agent, or Firm*—Karl F. Ross; Herbert Dubno

[57] ABSTRACT

A method of making a slide-fastener stringer in which a continuously woven tape and a coupling element interwoven with the tape are formed continuously and the coupling elements of the resulting continuous web are gapped to permit insertion of the slider onto the web which can then be subdivided into individual slide-fastener stringers. According to the invention, weft yarns pass beneath the bight connecting the coupling members of the continuous coupling element and over warp yarns which are thereby held over the shanks of the coupling members by these wefts so as to be drawn away from the bights and so as to lock the warp yarns thus bunched together preventing them from raveling upon gapping of the web.

4 Claims, 7 Drawing Figures

SLIDE FASTENER STRINGER AND METHOD OF MAKING SAME

CROSS REFERENCE TO RELATED APPLICATIONS

The present application is related to the commonly owned copending applications Ser. No. 195,000 filed Oct. 9, 1980 now U.S. Pat. No. 4,362,191 issued Dec. 7, 1982 and Ser. No. 237,672 filed Feb. 24, 1981, both entitled "WOVEN SLIDE-FASTENER STRINGER."

FIELD OF THE INVENTION

My present invention relates to woven slide-fastener stringers of the type having a continuous coupling element formed from a synthetic resin monofilament and whose coupling members have shanks which are interwoven with the warp and weft of the support tape so that the coupling element is woven into the tape, i.e. a woven slide-fastener stringer. The invention also relates to a method of making slide fasteners of this type.

BACKGROUND OF THE INVENTION

A slide fastener generally comprises a pair of stringer tapes along confronting edges of which are mounted rows of coupling heads or teeth which interdigitate upon movement of a slider along these rows.

The tapes and the respective rows of coupling heads form stringers which can be provided at the opposite ends with stop members (endstop members) preventing withdrawal of a slider, means for coupling the two tapes or slide-fastener halves together in the case of a nonseparable slide fastener, or male and female formations enabling the coupling and decoupling of the stringer halves in the case of a separable slide fastener.

The tapes are generally incorporated, e.g. by stitching, in opposite sides of an article having an opening which can be closed by the slide fastener. The slide-fastener art has advanced rapidly in recent years both with respect to techniques with the fabrication of the stringers and with respect to improvements in the mechanical and esthetic properties thereof.

For example, woven support tapes which have hitherto been provided with the coupling heads by clamping, molding or rows of stitching, have increasingly been provided with the heads directly during the tape-weaving operation utilizing conventional or only slightly modified tape looms to allow the coupling heads to be mounted on the edges of the tape as the tape is woven.

In recent years, moreover, individually mounted coupling heads have tended to be replaced by continuous coupling elements composed of a synthetic resin monofilament and of coil or meander configuration. The individual coupling heads can be formed by deformation, e.g. molding, bending or kinking the monofilament at spaced-apart locations, to so shape the head that it has lateral protrusions which can engage behind the heads of the opposing coupling element when the two are interdigitated, i.e. when the heads of one coupling element are fitted into the interstices or head spaces of the opposing coupling element.

The heads have shanks which reach toward the respective tapes and can be connected to the shanks of adjoining heads by connecting members or bights. Each head and the associated pair of shanks will be referred to hereinafter as a coupling member and, because coils of the type described have a generally dentate configuration, the coupling heads of the coupling members may be referred to as "teeth."

With respect to woven support tapes, reference will be made to the ground weave which, of course, is intended to mean the woven fabric consisting of weft yarns and warp yarns to which the coupling element is secured. The coupling element itself is the continuous monofilament member provided with the succession of coupling members as defined above, therealong.

A ground weft is, therefore, a weft yarn structure of the ground weave. A "double weft" or "double weft insertion" is a weft of a single yarn having two passes received in the same warp pockets or shed in traversing the tape.

Reference will also be made herein to "warp pockets" for the sake of convenience. In a conventional weaving operation, the warp is shedded, i.e. certain of the warp yarns are lifted while others are lowered from the plane of the tape and, between the lifted and lowered warps forming the shed, a weft is inserted. This is referred to as a weft insertion.

When the heddles are next activated, other warp yarns are lifted and lowered, respectively, to form another shed in which a weft insertion is placed. As a consequence, the warps which pass over and under a particular weft insertion form "pockets" in which the weft can be said to have been inserted.

Reference may also be had to German Open Application (Offenlegungsschrift) DE-OS No. 22 19 907 and the corresponding U.S. Pat. No. 3,880,203 of the present applicant, issued Apr. 29, 1975, in which a stringer is described having a stringer tape composed of the warp yarns and double wefts formed from a continuous ground weft yarn. The coupling element is here woven into the tape or is secured to the tape by weaving. In this case, the two shanks of each coupling member can also form a double weft which is secured to the ground weave by warp yarns at least in part.

The aforementioned copending applications and their corresponding German applications P No. 29 41 067.1 and P No. 30 07 276.5 also make it clear that each coupling head, overhanging an edge of the respective support tape, can have a pair of shanks reaching inwardly from this edge, these shanks being superposed, i.e. so oriented that one shank lies above the other so that the two shanks together form the equivalent of a double weft constituting a single weft insert in respective pockets of a binding warp, i.e. warp yarns which are interwoven with the double-weft yarns of the ground weave and also serve to anchor the coupling element to the support tape.

To simplify the description of the prior art, as far as it concerns the present application, and to distinguish sharply the point at which the invention begins, it should be noted that it is known to provide a slide fastener stringer with a woven support tape and a synthetic resin monofilament coupling element woven into this tape, the tape comprising ground warp yarns and successive weft inserts in the form of double wefts of a continuous ground weft yarn, the coupling element having coupling members each of whose shanks form a synthetic resin monofilament double weft disposed such that one shank lies directly above the other, i.e. the shanks have a common projection in the slide-fastener plane or projections which are substantially superimposed.

These coupling members are interconnected in the continuous coupling element by arcuate bights and the shanks are engaged by binding weft yarns and thereby united with the tape. Furthermore, the double-weft insertions of the ground weft yarn, in the region between the coupling members and the double-weft insertions of the ground weft yarn elsewhere in the tape fabric and beneath the coupling members are received in respective warp pockets, these warp pockets including warp pockets directly underlying the bights.

Slide-fastener stringers of this type can be formed by needle weft insertion tape looms at high speeds using needles to insert the double weft insertions of the ground weft yarn on the one hand and the double weft insertions of the monofilament on the other.

In the above mentioned application Ser. No. 195,000, corresponding to German application P No. 29 41 067.1, there is claimed a slide-fastener stringer of the latter type in which the binding warp yarns are in a pattern offset from one another by two weft insertions (two-pick stagger), each passing over (overshooting) a pair of coupling members in succession, overshooting the next (third) coupling member and passing under (undershooting) the next (fourth) coupling member in the repetition pattern. Furthermore, each binding warp yarn, between the overshot pair of coupling members and the next (third) coupling member in the repetition pattern is, in turn, overshot by double-weft insertions of the ground weft yarn while the binding warp yarns overshoot the double weft insertions of the ground weft between the individually overshot (third) member and the undershot (fourth) member of the repetition.

While this arrangement has been found to be highly successful in affording high production rates and an effective stringer, the structure described is inherently associated with a problem described below.

Since the binding warp yarns do not form bridges with the ground weft yarns, the double-weft insertions of the ground weft yarns on the one hand and the monofilament double-weft insertions on the other hand lie at different levels transverse to the slide-fastener plane in the two slide-fastener halves.

Furthermore, the binding warp yarns extend to the region of the bights, i.e. practically overlie the bent portions which interconnect the coupling members.

It has been found that, when the two slide-fastener heads are fabricated as a continuous band or web by high speed needle-insertion looms of the aforedescribed type, whereby the stringers are separated from this band subsequently, it is necessary to "gap" the coupling elements at spaced locations along the length of the continuous band or web.

Such gapping is required in the semifinished product to enable a slider to be drawn onto the interconnected coupling elements of each section of the band intended to form a respective spring. The stringer length can then be cut apart from one another at the region formed by the gapping action and, if desired, endstop members or the like can be applied.

The gapping is effected by stamping or cutting away all or part of one or more coupling members in the region in which coupling is desired. When the bights of the otherwise continuous monofilament coupling elements are severed, cut away or otherwise destroyed by the gapping procedure, the gapping members thus freed from the continuity of the strand can pull out, the binding warp yarns can unravel and the connection of the coupling element to the tape can be destroyed.

This danger is especially pronounced when the bindings of the yards lie against the bight or extend over the arcuate portions thereof.

As a result, the continuous band produced by the aforedescribed method and with the structure set forth in application Ser. No. 195,000 has been treated as a nongappable band, i.e. a preliminary gapping in the region of the gapping members is avoided and the stringers are severed from the band in an operation which retains the coupling elements in a stable condition as the slider is applied for in a procedure whereby endstop members are formed on the stringers thus severed from the band.

OBJECTS OF THE INVENTION

It is the principal object of the present invention to provide an improved method of making a slide-fastener stringer where disadvantages of the earlier systems described can be avoided.

Another object of the invention is to provide a method of making slide-fastener stringers in which the gappable continuous band can be formed without the dangers of disruption of the connection between the coupling element and the tape characterizing earlier systems.

Still another object of the invention is to provide an improved slide fastener stringer.

SUMMARY OF THE INVENTION

These objects and others which will become apparent hereinafter are obtained in accordance with the present invention, in a method of making a slide fastener stringer which comprises weaving a continuous band comprising a pair of support tapes and respective interdigitated synthetic resin monofilament coupling elements woven into the respective tapes, each tape comprising round warp yarns and successive weft insertions in the form of double wefts of a continuous ground weft yarn, each coupling element having coupling members with pairs of shanks extending from respective coupling heads and forming synthetic resin monofilament double-weft insertions disposed such that the shanks have a superimposed projection in the slide fastener plane, the double-weft insertions of the ground weft yarn in the region between the coupling members and the double-weft insertions of the ground weft yarn beneath the coupling members lying in respective warp yarn pockets, the ground warp pockets for the ground weft inserts beneath the coupling members being overlain by the coupling members.

According to the invention, binding warp yarns each extend over at least two coupling members as binding warp yarn bridges and, between those overshot coupling members, the double-weft insertion of the ground weft yarn passes over the binding warp yarn, i.e. is carried thereby, with the resulting loop of double weft insertion bundling the binding warp yarns in the region of the straight shank portions and away from the bights so that the binding warp yarns are retracted from these bights.

This system includes an arrangement where only the most rearwardly portion of the bight, corresponding to the monofilament thickness, are free from the binding warp yarns as well as arrangements in which the binding warp yarns are held at a significant distance from the most rearward portion of the bight.

When reference is made to the fact that the binding warp yarns "carry" the ground weft loops which bundle them together, it is intended thereby to describe a system in which these loops extend upwardly between the coupling members substantially to the level of the tensioned binding warp yarns, i.e. approximately to the level of the upper surfaces of the coupling members or the shanks thereof.

In a preferred embodiment of the invention, the binding warp yarns are offset relative to one another with respect to the warp inserts, i.e. have a one-weft, two-weft or greater stagger, but are all bundled together by each of the warp insertion loops mentioned previously.

When reference is made herein to the binding warp yarn which spans at least two coupling members and forms weft yarn bridges, I intend to indicate that these portions of the binding weft yarns are not drawn by the weft insertions of the ground weft forming the loops downwardly into the support tape plane but rather lie generally in the region of the upper shanks of the coupling members or the upper surfaces thereof. The yarn tension is set accordingly.

If reference is made to the above mentioned copending application Ser. No. 237,672, corresponding to German application P No. 30 07 276.5, it can be observed that double-weft insertions of the ground weft yarn may be provided between coupling members and are drawn into packing or cushioning loops up to or above the level of the upper shanks of the coupling members. This serves to fill the spaces between the coupling members with uniform packing or cushioning masses to improve the stability of the slide fastener against sharp bending. Of course, a similar improvement appears in the present case as well although there the yarn tension and disposition of the yarns is not such that the binding warp yarns are bundled away from the bights of the coupling members.

As a result, a web can be stamped, milled or otherwise gapped without danger that the binding warp yarns will be unraveled.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
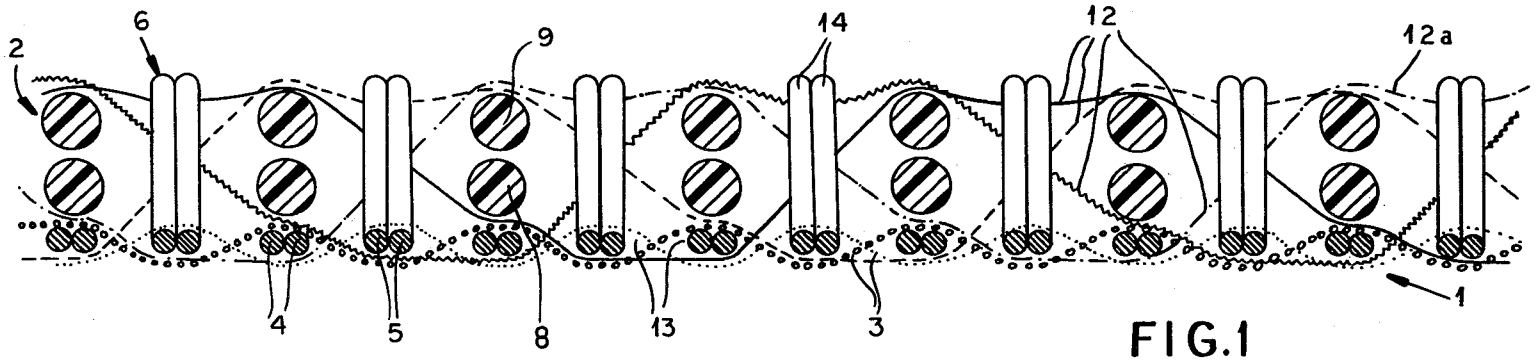
FIG. 1 is a diagrammatic cross sectional view illustrating, in greatly enlarged scale, the weft and warp patterns in accordance with the invention and showing their relationship with shanks of the coupling members, which have been shown in section as well.

FIGS. 1 through 4 show a slide fastener stringer having a pair of woven stringer tapes 1, only one of which has been illustrated. The coupling element of the nonillustrated stringer tape is nevertheless shown to be interdigitated with the coupling element of the stringer tape shown in some detail.

Woven into and onto the stringer tape 1 is a coupling element 2 of the synthetic resin monofilament type.

The support tape is formed by ground warp yarns 3 and successive double weft insertions 4, 5 of a continuous ground weft yarn 6. The double weft insertions 4 are disposed beneath coupling members while the double weft insertions 5 are termed interstitial double weft insertions and are disposed between the coupling members.

Each coupling element 2 is comprised of a multiplicity or row of coupling members 7 having heads 10 which are adapted to interdigitate. Thus each head 10 of one coupling element 2 can fit between two heads 10 of the other coupling element.

Figure 2:
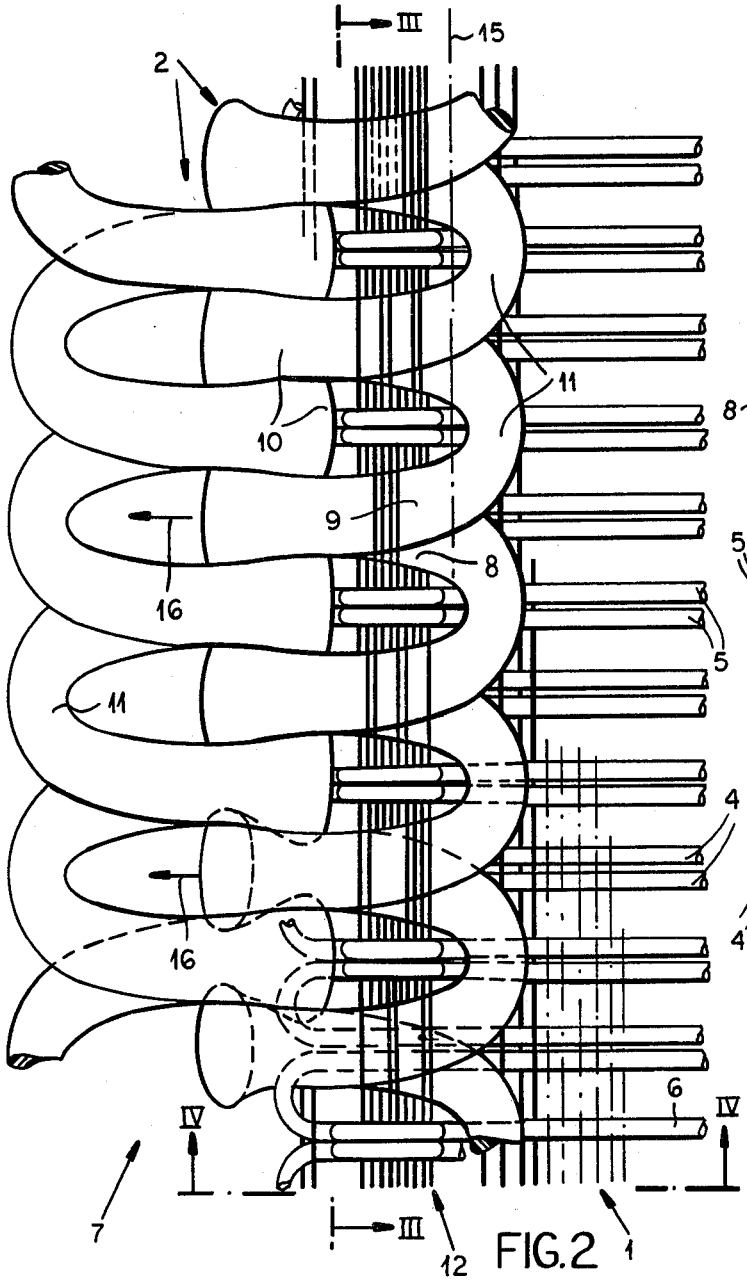
FIG. 2 is a plane view of a slide fastener using the pattern of FIG. 1.
Figure 5:
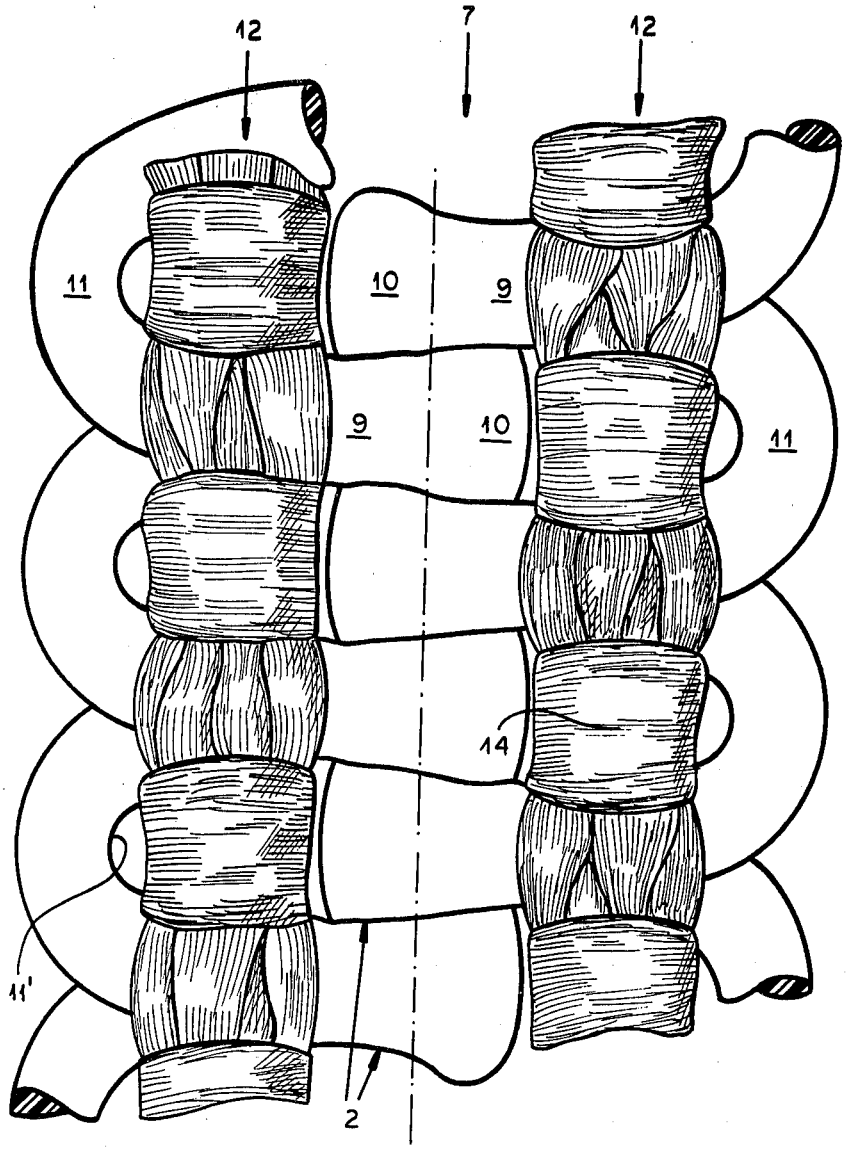
FIG. 5 is a plan view similar to FIG. 2 showing both the padding effect and the tending in a less diagrammatic form.

Each head 10 is connected by a pair of rearwardly extending shanks 8, 9 which, as will be apparent, from a comparison of FIGS. 2 and 5 have primarily straight portions terminating in arcuate bights 11 which, at the rear of the coupling element, interconnect the coupling members, i.e. join shanks of adjacent coupling members together.

The shanks 8 are referred to as bottom shanks while the shanks 9 are top shanks, i.e. the shanks disposed more remotely from the ground weave. These shanks are disposed substantially one above another so that they generally have a common projection on the slide fastener plane, i.e. a plane parallel to the plane of the paper in FIG. 2.

The shanks 8, 9 are engaged by binding or connective warp yarns 12 and are anchored thereby to the support tape 1 so that the heads 10 project beyond the edge of the tape. Each pair of shanks 8, 9, with respect to the binding warp yarns, thus forms a synthetic resin monofilament double weft insertion.

The double weft insertions 5 on the one hand and the double weft insertions 4 on the other are received in respective ground warp yarn pockets 13.

Figure 6:
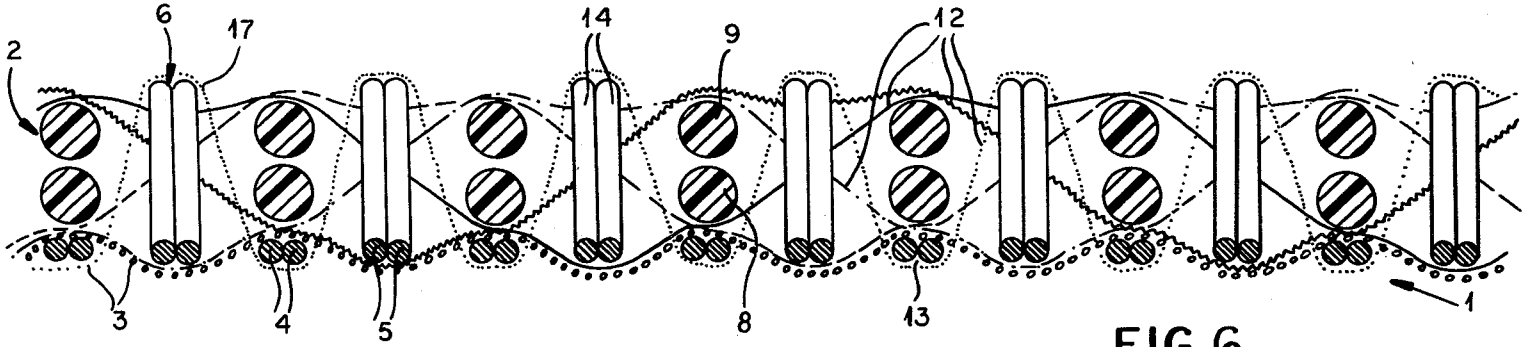
FIG. 6 is a view similar to FIG. 1 showing another patterning of the binding warp yarns.

As a comparison of FIGS. 1 and 6 will show, the binding warp yarns 12 passing over two coupling members 2 form winding warp yarn bridges 12*a*, i.e. warp yarn portions which are not drawn downwardly to or into the support type plan.

Between these coupling members, rather, the double weft insertions 5 loop upwardly at 14 to pass over the binding warp yarns and bundle them together (see also FIGS. 2 and 5).

Figure 7:
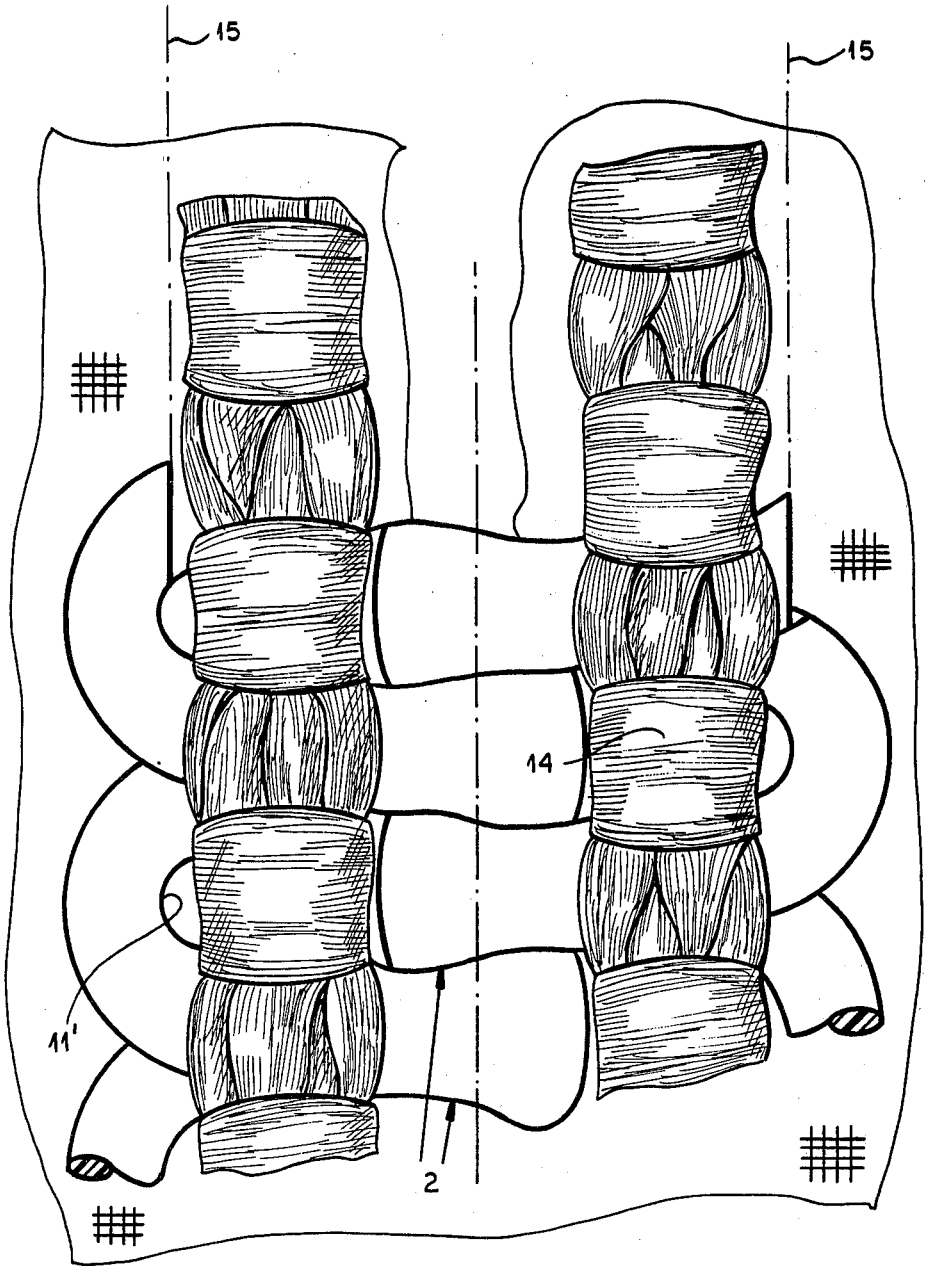
FIG. 7 is a diagrammatic plan view illustrating the gapping of a continuous band in accordance with the invention.

The yarn tension and the construction of loops 14 is such that the loops 14 hold the engaged binding warp yarns 12 substantially exclusively in the regions of the straight portions of the shanks 8 and 9, i.e. away from the rearmost portions 11′ of the bight 11. Thus this portion of each bight remains completely free from binding warp yarns 12. The zone to the right of the line 15 can thus be milled away and the upper three coupling members, for example in FIG. 2, move to the left to leave a gap as shown in FIG. 7 to permit a slider to be mounted.

Figure 3:
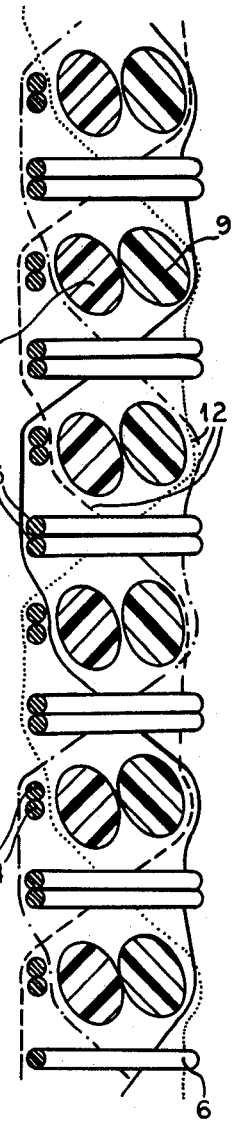
FIG. 3 is a section taken along the line III—III of FIG. 2.
Figure 4:
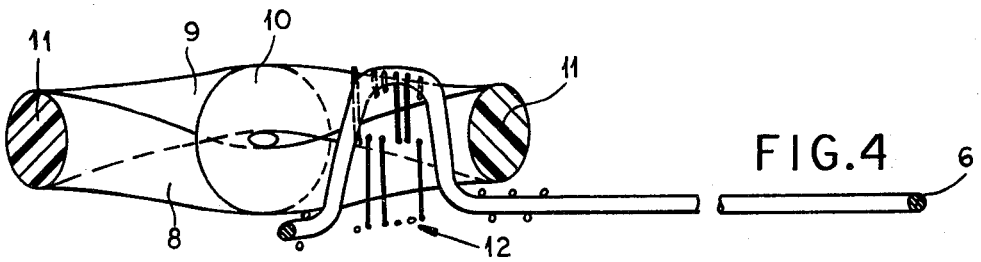
FIG. 4 is a section taken along the line IV—IV of FIG. 2.

In the longitudinal direction of the stringer the binding warp yarns 12 are staggered and in the embodiment shown the stagger is a two-pick stagger. For clarity the various winding warp yarns in FIGS. 1, 3 and 6 are shown by different types of lines, i.e. a wiggling line, a dotted line, a dot-dash line, etc. In the embodiment of FIG. 1, moreover, after passing over two pairs of shanks, the binding warp yarn in a repetition pattern passes beneath the next pair of shanks and above the ground weft double insertions 4, beneath the next double weft insertion 5, beneath the next pair of shanks and its ground double weft insertion 5.

Thus the binding warp yarns 12 then extend into the tape plane.

As is also apparent from the drawing one or more ground warp yarns 3 can be disposed between successive coupling members as ground warp support loops 17 which are drawn over the loops 14 (FIG. 6) substantially to the level of the upper shanks 9.

As has already been noted, the binding warp yarns 12 are bundled so that a cushion packs the space between the coupling members to define the interhead spacing and cushioning the end of the heads interdigitating therewith.

I claim:

1. A method of making a slide fastener stringer comprising the steps of:

weaving a continuous band consisting of at least one woven support tape and a continuous monofilament coupling element disposed along an edge of said tape with the support tape consisting of round warp yarns interwoven with a continuous ground weft yarn inserted into the warp as double weft insertions, said coupling element having a row of coupling members each formed with a coupling head projecting beyond said edge and a pair of shanks extending from each head over said edge whereby one of said shanks is disposed substantially directly over the other shank of each pair, and arcuate bights connecting each shank of a respective coupling member with shanks of adjacent coupling members, and binding warp yarns overlying the shanks for retaining said coupling element on said tape, each of said binding warp yarns having a repetitive weave pattern including the spanning of a pair of coupling members and forming a warp yarn bridge thereacross, said double weft insertions including weft yarn loops engaging said bridges and retaining said binding warp yarns away from the rearmost portion of said bights;

at spaced locations along said tape removing said rearmost portion of said bight from said coupling element thereby freeing a corresponding number of coupling members from the coupling element; and withdrawing the freed coupling members to gap said coupling elements at said location while leaving said binding warp yarns intact, each of said loops being engaged over all of the binding warp yarns between each pair of coupling members to pad the space therebetween.

2. The method defined in claim 1 wherein said coupling element is interdigitated with another coupling element of another support tape formed simultaneously with the first mentioned coupling element and support tape during the weaving thereof.

3. A slide fastener stringer made by the method of claim 1 or claim 2.

4. A method of making a slide fastener stringer comprising the steps of:

weaving a continuous band consisting of at least one woven support tape and a continuous monofilament coupling element disposed along an edge of said tape with the support tape consisting of round warp yarns interwoven with a continuous ground weft yarn inserted into the warp as double weft insertions, said coupling element having a row of coupling members each formed with a coupling head projecting beyond said edge and a pair of shanks extending from each head over said edge whereby one of said shanks is disposed substantially directly over the other shank of each pair, and arcuate bights connecting each shank of a respective coupling member with shanks of adjacent coupling members, and binding warp yarns overlying the shanks for retaining said coupling element on said tape, each of said binding warp yarns having a repetitive weave pattern including the spanning of a pair of coupling members and forming a warp yarn bridge thereacross, said double weft insertions including double-weft loops engaging over said bridges substantially in a plane defined by portions of said ones of said shanks turned away from said tape and retaining said binding warp yarns away from the rearmost portion of said bights;

at spaced locations along said tape removing said rearmost portion of said bight from said coupling element thereby freeing a corresponding number of coupling members from the coupling element; and withdrawing the freed coupling members to gap said coupling element at said location while leaving said binding warp yarns intact.

* * * * *